US011688953B2

(12) United States Patent
Huang et al.

(10) Patent No.: US 11,688,953 B2
(45) Date of Patent: Jun. 27, 2023

(54) TERMINAL DEVICE

(71) Applicant: VIVO MOBILE COMMUNICATION CO., LTD., Guangdong (CN)

(72) Inventors: Huan-chu Huang, Dongguan (CN); Yijin Wang, Dongguan (CN); Xianjing Jian, Dongguan (CN)

(73) Assignee: VIVO MOBILE COMMUNICATION CO., LTD., Guangdong (CN)

( * ) Notice: Subject to any disclaimer, the term of this patent is extended or adjusted under 35 U.S.C. 154(b) by 281 days.

(21) Appl. No.: 17/213,898

(22) Filed: Mar. 26, 2021

(65) Prior Publication Data

US 2021/0218155 A1 Jul. 15, 2021

Related U.S. Application Data

(63) Continuation of application No. PCT/CN2019/101512, filed on Aug. 20, 2019.

(30) Foreign Application Priority Data

Sep. 28, 2018 (CN) ..... 201811142574.7

(51) Int. Cl.
*H01Q 21/06* (2006.01)
*H01Q 9/04* (2006.01)
*H01Q 21/00* (2006.01)

(52) U.S. Cl.
CPC ..... *H01Q 21/065* (2013.01); *H01Q 9/045* (2013.01); *H01Q 21/0031* (2013.01)

(58) Field of Classification Search
CPC ... H01Q 21/065; H01Q 9/045; H01Q 21/0031
See application file for complete search history.

(56) References Cited

U.S. PATENT DOCUMENTS 4,401,988 A * 8/1983 Kaloi ..... H01Q 19/005 343/700 MS
4,403,221 A 9/1983 Lamberg et al.
(Continued)

FOREIGN PATENT DOCUMENTS

CN 2938452 Y 8/2007
CN 102117962 A 7/2011
(Continued)

OTHER PUBLICATIONS

Supplementary European Search Report for Application No. 19867529.0-1205/3859880—PCT/CN2019/101512, dated Oct. 14, 2021.
(Continued)

*Primary Examiner* — Dieu Hien T Duong
(74) *Attorney, Agent, or Firm* — Harness, Dickey & Pierce, P.L.C.

(57) ABSTRACT

A terminal device includes feed sources, a metal frame, coupling patches, and radiating patches, where at least two grooves are formed in the outer side surface of the metal frame, two first through holes are formed in each groove, a coupling patch and a radiating patch are arranged in each groove; the coupling patch in each groove is arranged between the radiating patch and the bottom of the groove, and two second through holes are formed in the coupling patch; two antenna feed points are arranged on each radiating patch, each feed source is connected to one antenna feed point through one first through hole and one second through hole; and the metal frame, the coupling patch, and the radiating patch are not in contact with one another, and an area of the radiating patch is less than an area of the coupling patch.

10 Claims, 5 Drawing Sheets

(56) References Cited

U.S. PATENT DOCUMENTS

| | | | | |
|---|---|---|---|---|
| 2007/0132642 | A1 | 6/2007 | Iluz et al. | |
| 2013/0278468 | A1* | 10/2013 | Yehezkely | H01Q 1/2266 343/702 |
| 2015/0188239 | A1 | 7/2015 | Tong et al. | |

FOREIGN PATENT DOCUMENTS

| | | | |
|---|---|---|---|
| CN | 203481374 | U | 3/2014 |
| CN | 104103906 | A | 10/2014 |
| CN | 204167474 | U | 2/2015 |
| CN | 108336491 | A | 7/2018 |
| CN | 108400424 | A | 8/2018 |
| CN | 108417995 | A | 8/2018 |
| CN | 109066055 | A | 12/2018 |
| CN | 109215978 | A | 1/2019 |
| EP | 2477275 | A1 | 7/2012 |
| GB | 2005922 | A | 4/1979 |
| JP | 2007235592 | A | 9/2007 |
| WO | WO2014/190652 | A1 | 12/2014 |

OTHER PUBLICATIONS

International Search Report and Written Opinion of the International Searching Authority regarding International Patent Application No. PCT/CN2019/101512, dated Nov. 12, 2019. Translation provided by Bohui Intellectual Property.

First Office Action regarding Chinese Patent Application No. 201811142574.7, dated Nov. 12, 2019. Translation provided by Bohui Intellectual Property.

Second Office Action regarding Chinese Patent Application No. 201811142574.7, dated Jun. 15, 2020. . Translation provided by Bohui Intellectual Property.

* cited by examiner

TERMINAL DEVICE

CROSS-REFERENCE TO RELATED APPLICATIONS

This application is a continuation application of PCT Application No. PCT/CN2019/101512, filed on Aug. 20, 2019, which claims priority to Chinese Patent Application No. 201811142574.7 filed on Sep. 28, 2018, both of which are incorporated herein by reference in their entireties.

TECHNICAL FIELD

The present disclosure relates to the field of communications technologies, and in particular, to a terminal device.

BACKGROUND

With rapid development of communications technologies, multi-antenna communication has become a mainstream and future development trend of a terminal device. In addition, in this process, a millimeter-wave antenna is gradually introduced to the terminal device. In the related technologies, the millimeter-wave antenna is generally in a form of an independent antenna module. Therefore, an accommodating space needs to be disposed in the terminal device for this independent antenna module. In this way, a size of the entire terminal device is relatively large, so that overall competitiveness of the terminal device is relatively low.

SUMMARY

The embodiments of the present disclosure provide a terminal device, including feed sources, a metal frame, coupling patches, and radiating patches, where at least two grooves are formed in the outer side surface of the metal frame, two first through holes are formed in each groove, a coupling patch and a radiating patch are arranged in each groove, and the metal frame is grounded; the coupling patch in each groove is arranged between the radiating patch and the bottom of the groove, and two second through holes are formed in the coupling patch; two antenna feed points are arranged on each radiating patch, each feed source is connected to one antenna feed point through one first through hole and one second through hole, and the antenna feed points, the first through holes, and the second through holes in each groove are in one-to-one correspondence; and the metal frame, the coupling patch, and the radiating patch are not in contact with one another, a non-conductive material is filled between the metal frame, the coupling patch, and the radiating patch, and an area of the radiating patch is less than an area of the coupling patch.

BRIEF DESCRIPTION OF DRAWINGS

To describe the technical solutions in some embodiments of the present disclosure more clearly, the following briefly describes the accompanying drawings required in some embodiments of the present disclosure. The accompanying drawings in the following descriptions show merely some embodiments of the present disclosure, and a person of ordinary skill in the art may still derive other drawings from these accompanying drawings.

DESCRIPTION OF EMBODIMENTS

The following clearly describes the technical solutions in some embodiments of the present disclosure with reference to the accompanying drawings in some embodiments of the present disclosure. The described embodiments are some but not all of the embodiments of the present disclosure. All other embodiments obtained by a person of ordinary skill in the art based on the embodiments of the present disclosure shall fall within the protection scope of the present disclosure.

Figure 1:
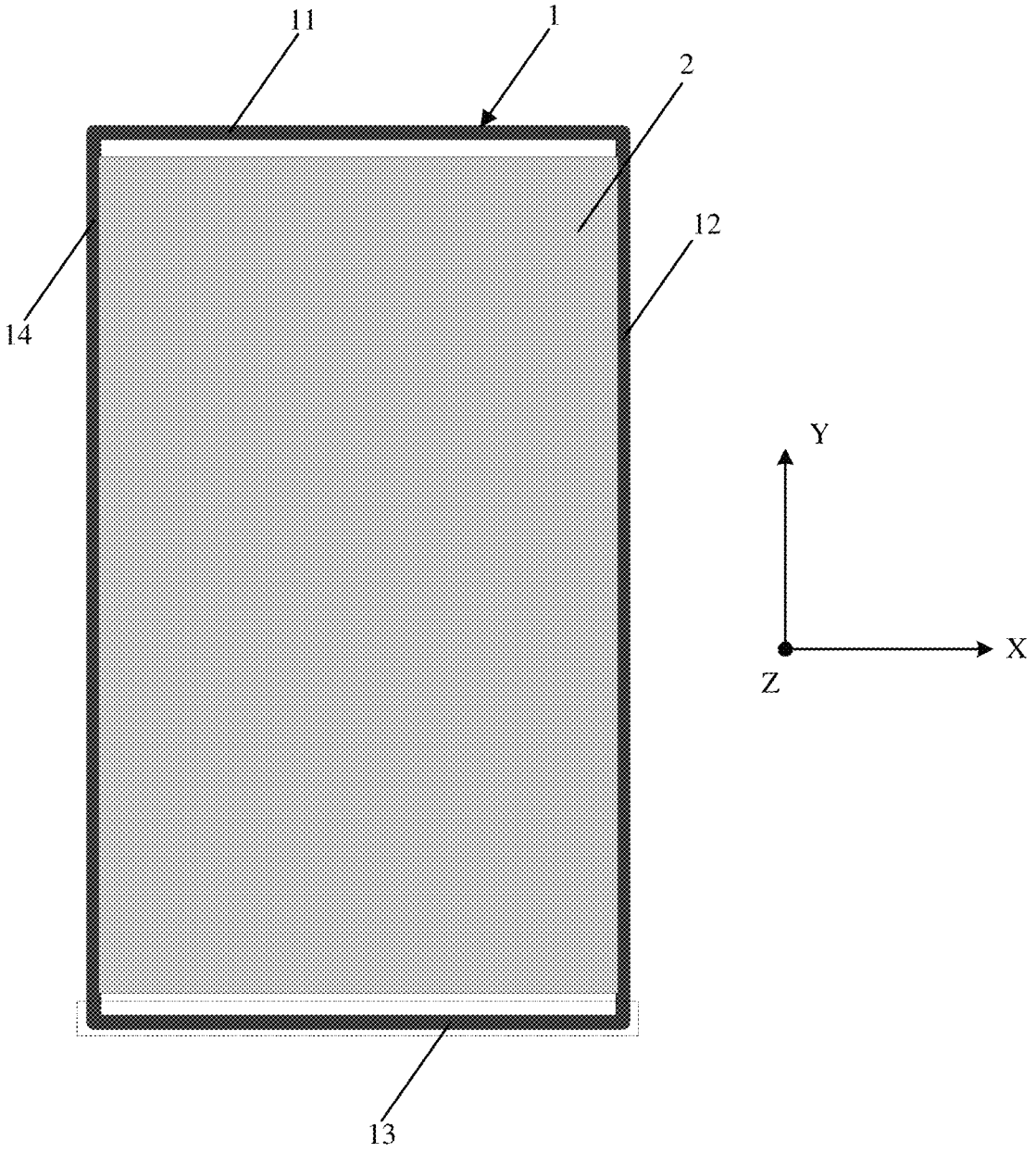
FIG. 1 is a schematic structural diagram of a terminal device according to an embodiment of the present disclosure.

Referring to FIG. 1, FIG. 1 is a schematic structural diagram of a terminal device according to an embodiment of the present disclosure. As shown in FIG. 1, the terminal device includes feed sources, a metal frame 1, coupling patches, and radiating patches. At least two grooves are formed in the outer side surface of the metal frame 1, two first through holes are formed in each groove, a coupling patch and a radiating patch are arranged in each groove, and the metal frame 1 is grounded. The coupling patch in each groove is arranged between the radiating patch and the bottom of the groove, and two second through holes are formed in the coupling patch. Two antenna feed points are arranged on each radiating patch, each feed source is connected to one antenna feed point through one first through hole and one second through hole, and the antenna feed points, the first through holes, and the second through holes in each groove are in one-to-one correspondence. The metal frame 1, the coupling patch, and the radiating patch are not in contact with one another, a non-conductive material is filled between the metal frame, the coupling patch, and the radiating patch, and an area of the radiating patch is less than an area of the coupling patch. The feed source is a millimeter-wave feed source. The antenna feed points, the first through holes, and the second through holes may be formed by directly facing one another or not directly facing one another.

In this embodiment, the foregoing metal frame 1 may include a first side edge 11, a second side edge 12, a third side edge 13, and a fourth side edge 14. The metal frame 1 may be a frame connected end to end or disconnected end to end. The foregoing metal frame 1 is grounded and may be electrically connected to a ground plate 2 in the terminal device. The ground plate 2 may be a circuit board or a metal middle cover. The foregoing coupling patches and radiating patches may be metal conductors, like the metal frame 1, to maintain a metal appearance of the terminal device.

In this embodiment, to better understand the foregoing setting method, refer to FIG. 2 to FIG. 7. Each of FIG. 2 to FIG. 7 is a schematic structural diagram of a side edge of a metal frame according to an embodiment of the present disclosure.

Figure 2:
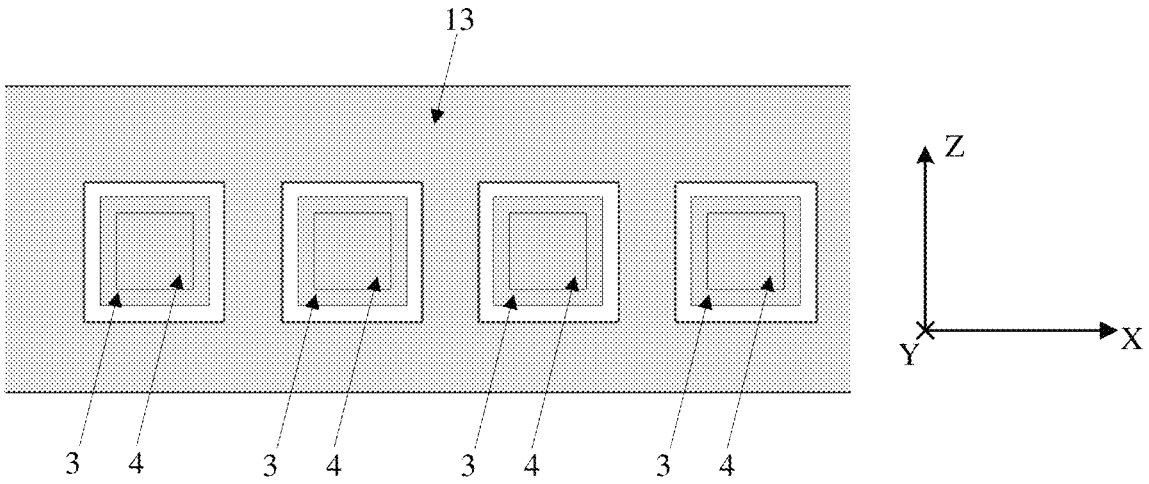
FIG. 2 is a first schematic structural diagram of a side edge of a metal frame according to an embodiment of the present disclosure.
Figure 7:
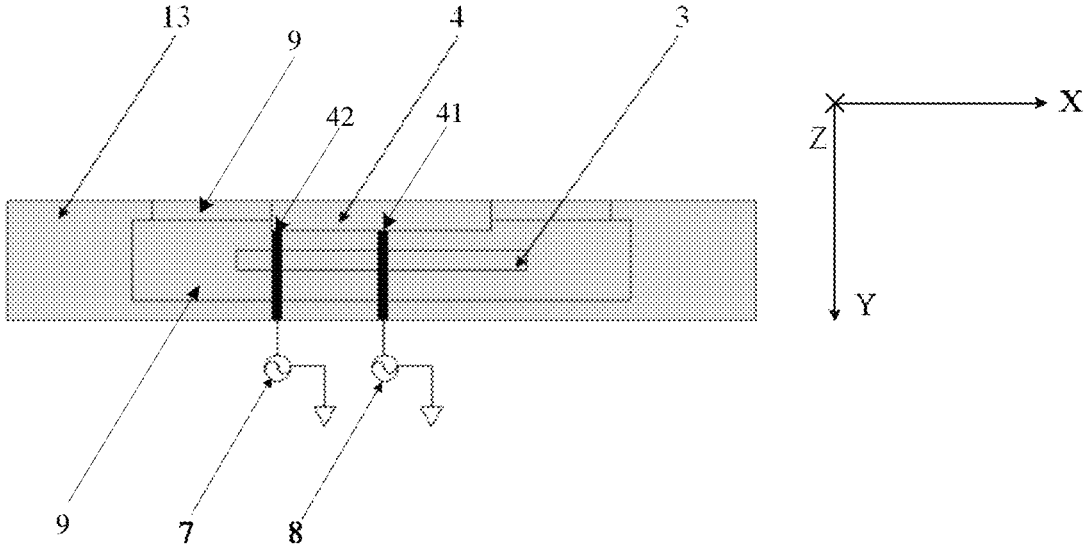
FIG. 7 is a sixth schematic structural diagram of a side edge of a metal frame according to an embodiment of the present disclosure.

First, as shown in FIG. 2, a plurality of square grooves are formed in the third side edge 13 of the metal frame 1, a coupling patch 3 and a radiating patch 4 are arranged in each groove, the coupling patch 3, the radiating patch 4, the groove, and a millimeter-wave feed source signal constitute a millimeter-wave antenna, and a plurality of millimeter-wave antennas constitute a millimeter-wave array antenna. As shown in FIG. 7, a gap between the millimeter-wave antenna in the groove and the metal frame 1 is filled with a non-conductive material 9. A dielectric constant of an optional non-conductive material 9 is 2.2, and a loss tangent is 0.0009.

Figure 3:
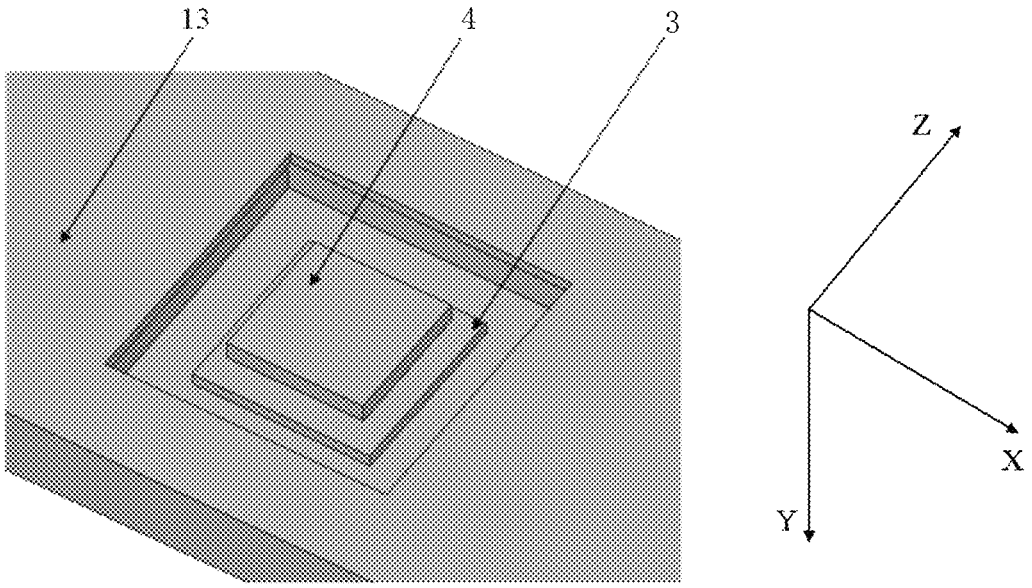
FIG. 3 is a second schematic structural diagram of a side edge of a metal frame according to an embodiment of the present disclosure.
Figure 4:
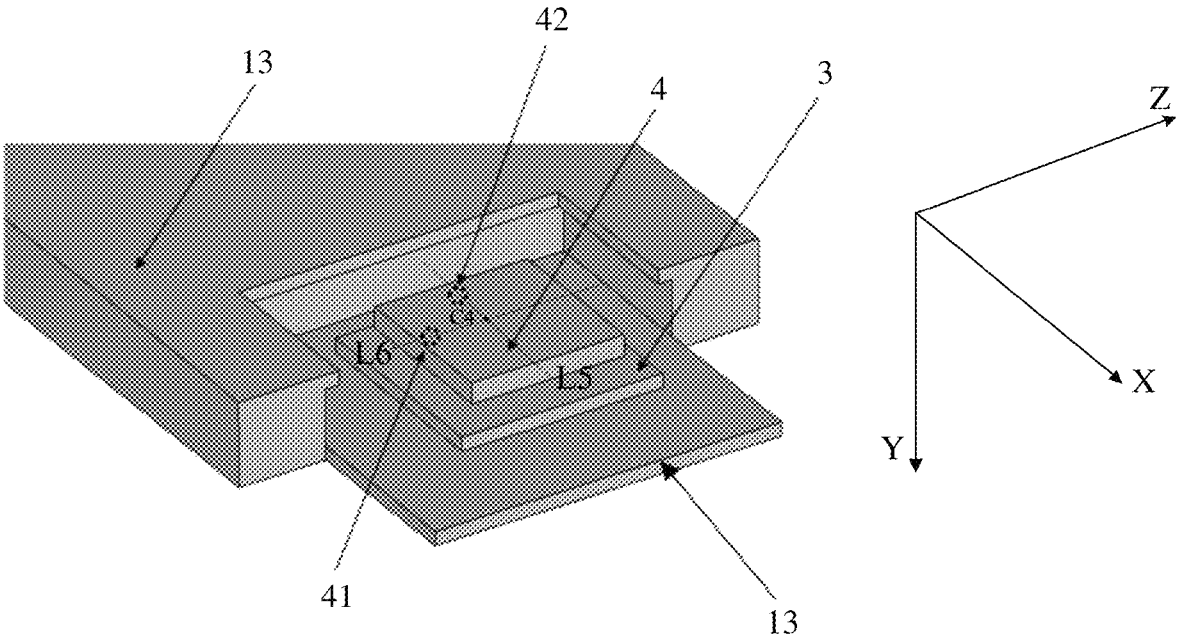
FIG. 4 is a third schematic structural diagram of a side edge of a metal frame according to an embodiment of the present disclosure.

Further, referring to FIG. 3 and FIG. 4, a groove is formed in the third side edge 13 of the metal frame 1, the coupling patch 3 in the groove is arranged between the radiating patch 4 and the bottom of the groove, and the metal frame 1, the coupling patch 3, and the radiating patch 4 are not in contact with one another. A specific interval exists between the coupling patch 3 and the radiating patch 4, and optionally may be 0.2 mm. A specific interval exists between the coupling patch 3 and the bottom of the groove, and optionally may be 0.4 mm.

In FIG. 4, there are two antenna feed points on the radiating patch 4, such as a first feed point 41 and a second feed point 42. The first feed point 41 may receive a first feed source signal, and the second feed point 42 may receive a second feed source signal. The first feed source signal and the second feed source signal are both signals of feed sources. For example, as shown in FIG. 7, the feed sources may include a feed source 8 and a feed source 7.

Figure 5:
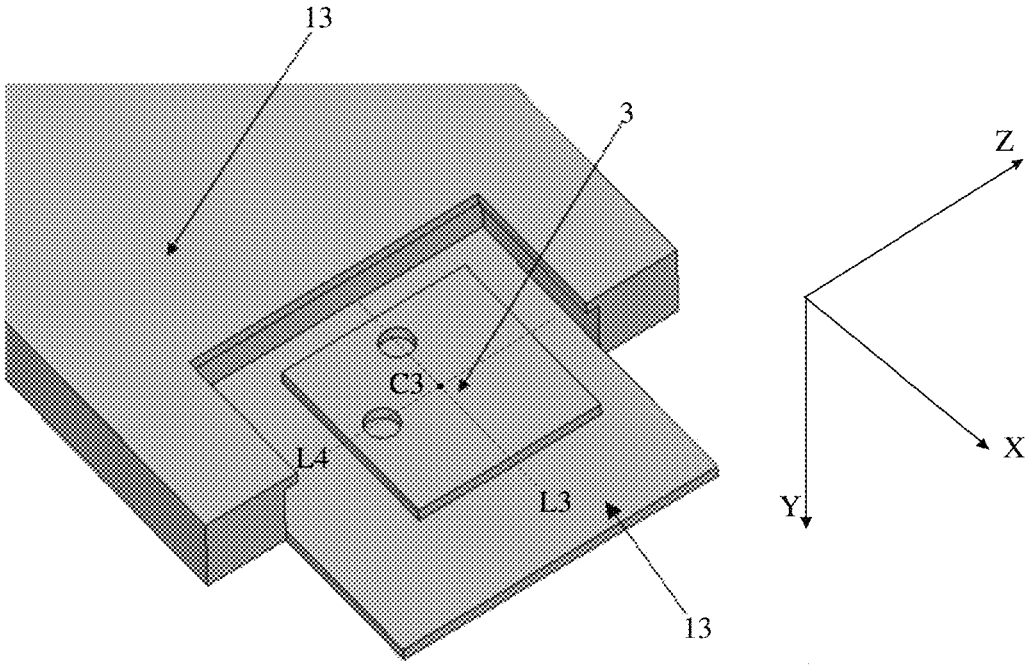
FIG. 5 is a fourth schematic structural diagram of a side edge of a metal frame according to an embodiment of the present disclosure.

Further, referring to FIG. 5, FIG. 5 shows a structure of removing the radiating patch 4 from FIG. 4. In this case, it can be learned that there are two second through holes on the coupling patch 3. In this way, the feed source may be electrically connected to the radiating patch 4 through different second through holes, and the feed source is not electrically connected to the coupling patch 3.

Figure 6:
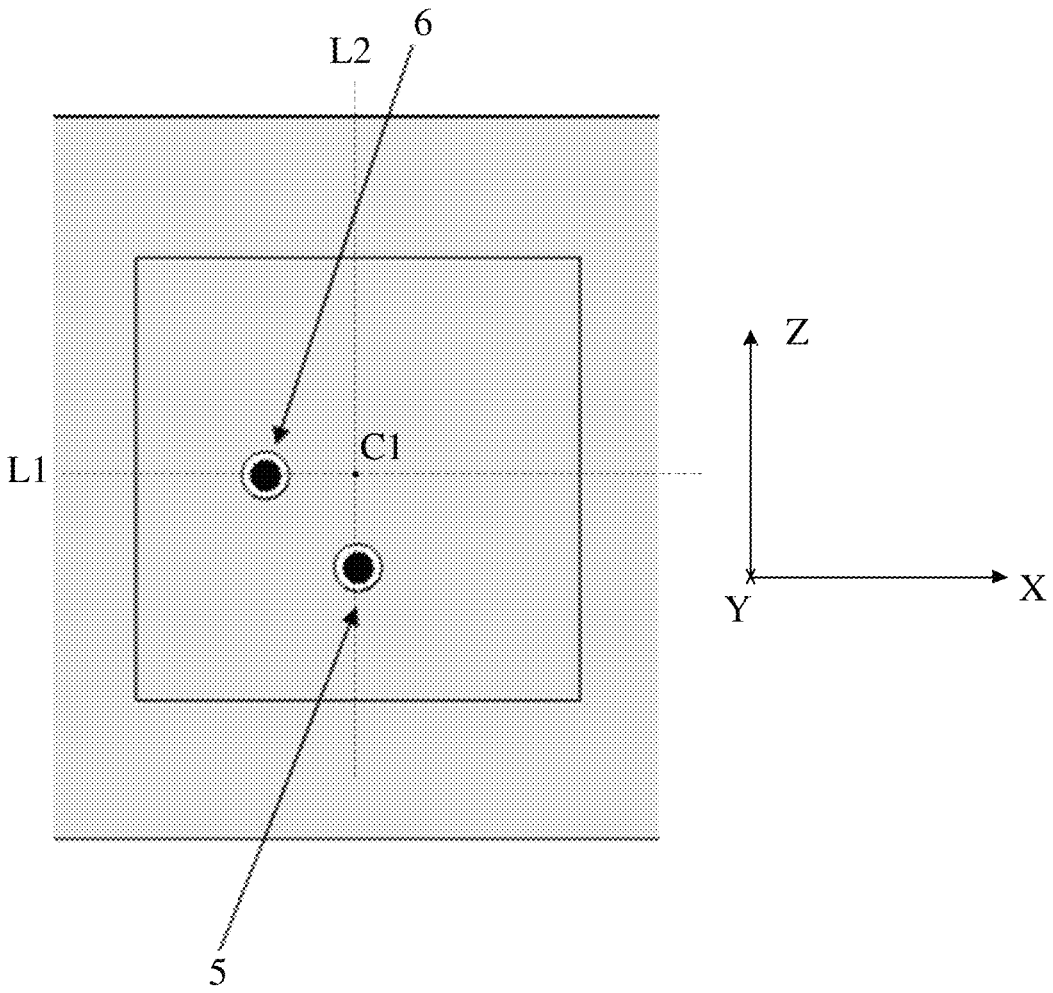
FIG. 6 is a fifth schematic structural diagram of a side edge of a metal frame according to an embodiment of the present disclosure.

Referring to FIG. 6, in FIG. 6, two first through holes are formed at the bottom of the groove, and are configured to access feed source signals of millimeter-wave antennas. In addition, the first through hole 5 may be configured to access the first feed source signal, and the first through hole 6 may be configured to access the second feed source signal. The first feed source signal and the second feed source signal are accessed to the bottom of the radiating patch 4, and are used to excite the millimeter-wave antenna to generate radiating signals, to support a multiple-input multiple-output (Multiple-Input Multiple-Output, MIMO) function.

Further, referring to FIG. 7, a groove is formed in the third side edge 13 of the metal frame 1, the coupling patch 3 in the groove is arranged between the radiating patch 4 and the bottom of the groove, two second through holes are formed in the coupling patch 3, and the two through holes in the coupling patch 3 directly face two through holes at the bottom of the groove. Two antenna feed points are arranged on the radiating patch 4, and the antenna feed points, the first through holes, and the second through holes in the groove are in one-to-one correspondence.

Figure 8:
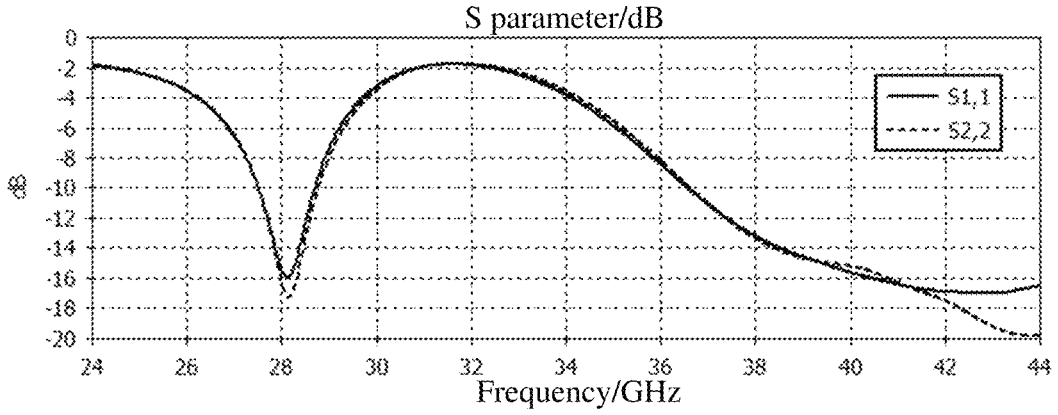
FIG. 8 is a schematic diagram of return loss of a single millimeter-wave antenna according to an embodiment of the present disclosure.

Further, referring to FIG. 8, FIG. 8 is a schematic diagram of return loss of a single millimeter-wave antenna according to an embodiment of the present disclosure. In this case, the single millimeter-wave antenna includes the coupling patch 3 and the radiating patch 4. As shown in FIG. 8, (S1, 1) is echo reflection formed by a feed signal of a first feed source signal, and (S2, 2) is echo reflection formed by a feed signal of a second feed source signal. By determining a bandwidth based on a −10 dB standard of (S1, 1) and (S2, 2), a bandwidth of this design can cover 27.5-28.5 GHz and 37-43.5 GHZ.

In this embodiment, at least two grooves are formed in an outer side surface of a metal frame 1, and a coupling patch 3 and a radiating patch 4 are arranged in each groove, which is equivalent to forming a millimeter-wave array antenna configured to radiate a millimeter-wave signal. When at least two grooves are formed in a third side edge 13, a communications antenna may be in an area shown by dashed lines in FIG. 1, and is composed of the third side edge 13, a part of a second side edge 12, and a part of a fourth side edge 14. Certainly, in addition to forming at least two grooves in the third side edge 13, at least two grooves may also be formed in each of a first side edge 11, the second side edge 12, and the fourth side edge 14. This is not limited in this embodiment.

In this way, when existing antennas (such as a cellular antenna and a non-cellular antenna) are retained and a 5G millimeter-wave antenna is compatible, there is an solution design that original discrete millimeter-wave antennas are integrated into existing non-millimeter-wave antennas in a terminal device to form mm-Wave Antenna in non-Wave Antennas (mm-Wave Antenna in non-mm-Wave Antennas, AiA), or there is an solution design that original discrete millimeter-wave antennas are integrated into an existing metal structure of a terminal device, without significantly increasing a size of an entire system. In addition, a metal design (such as a metal ring) of an appearance can be maintained, and an industrial design (Industrial Design, ID) is artistic and highly symmetrical. In addition, at a high screen-to-body ratio, it may avoid that when the terminal device is placed on a metal table in an upside-up (that is, a screen faces upwards) manner, a back of the terminal device is covered by the metal table, and it may also avoid the probability that due to hand holding, performance of the millimeter-wave antenna is greatly reduced, and user wireless experience is significantly degraded. A millimeter-wave array antenna can implement performance of multi-band millimeter-wave band coverage, and the antenna itself can form a multiple-input multiple-output antenna. In addition, during beam scanning, performance of the millimeter-wave array antenna in a spatial symmetrical or mapping direction may be the same or close.

In addition, the millimeter-wave antenna is integrated into a non-millimeter-wave communications antenna in the related technology without affecting communication quality of the non-millimeter-wave communications antenna. The millimeter-wave array antenna may obtain a better broadband bandwidth, which can cover a plurality of bands of a 5G millimeter wave, and is convenient for a full-screen antenna design. The present disclosure is designed based on a metal frame of the terminal device, does not affect a metal texture of the terminal device, and can improve wireless experience of a user in a plurality of millimeter-wave bands across countries and even in global roaming.

With a symmetrical design of an appearance of the millimeter-wave antenna, the terminal device may have a better and more competitive metal appearance. The metal frame is used as a reflector of the millimeter-wave antenna to obtain higher gain. The millimeter-wave antenna may be integrated with the non-millimeter-wave antenna that uses a metal frame as an antenna, that is, the millimeter-wave antenna is compatible with the non-millimeter-wave antenna that uses the metal frame as the antenna.

In this embodiment, the foregoing terminal device may be a mobile phone, a tablet computer, a laptop computer, a personal digital assistant (personal digital assistant, PDA), a mobile Internet device (Mobile Internet Device, MID), a wearable device, or the like.

Optionally, two through holes in each groove are at the bottom of the groove.

In this embodiment, the two through holes in each groove are at the bottom of the groove, so that the radiating patch 4 is electrically connected to a feed source through a short path, and the millimeter-wave antenna may have better performance.

Optionally, two second through holes in the coupling patch 3 directly face the two first through holes at the bottom of the groove.

In this embodiment, the two second through holes in the coupling patch 3 directly face the two first through holes at the bottom of the groove, so that the radiating patch 4 is electrically connected to a feed source through a short path, and the millimeter-wave antenna may have better performance.

Optionally, as shown in FIG. 6, a first straight line L1 determined by one of the two first through holes at the bottom of each groove and a center C1 of the bottom of the groove is parallel to a length direction of the metal frame 1, a second straight line L2 determined by the other first through hole and the center C1 of the bottom of the groove is parallel to a width direction of the metal frame 1, and the first straight line L1 is perpendicular to the second straight line L2;

as shown in FIG. 5, a third straight line L3 determined by one of the two second through holes in each coupling patch 3 and a center C3 of the coupling patch 3 is parallel to the length direction of the metal frame 1, a fourth straight line L4 determined by the other second through hole and the center C3 of the coupling patch 3 is parallel to the width direction of the metal frame 1, and the third straight line L3 is perpendicular to the fourth straight line L4; and as shown in FIG. 4, a fifth straight line L5 determined by one of the two antenna feed points on each radiating patch 4 and a center C4 of the radiating patch 4 is parallel to the length direction of the metal frame 1, a sixth straight line L6 determined by the other antenna feed point and the center C4 of the radiating patch 4 is parallel to the width direction of the metal frame 1, and the fifth straight line L5 is perpendicular to the sixth straight line L6.

In this embodiment, an orthogonal feeding method is used for feeding. A multiple-input multiple-output (that is, MIMO) function may be formed to increase a data transmission rate. In addition, a wireless connection capability of the millimeter-wave antenna may be improved, a probability of communication disconnection may be reduced, and a communication effect and user experience may be improved.

Optionally, a surface, away from the coupling patch 3, of the radiating patch 4 is aligned with a plane at which an outer side wall of the metal frame 1 is located.

In this embodiment, to better understand the foregoing setting manner, still refer to FIG. 7. The surface, away from the coupling patch 3, of the radiating patch 4 is aligned with the plane at which the outer side wall of the metal frame 1 is located. In other words, the surface, away from the coupling patch 3, of the radiating patch 4 and the plane at which the outer side wall of the metal frame 1 is located are the same plane. Through this setting manner, it may ensure that the terminal device has a better appearance.

Optionally, a shape of the groove, the coupling patch 3, or the radiating patch 4 is a circle or a regular polygon.

In this embodiment, the shape of the groove, the coupling patch 3, or the radiating patch 4 is the circle or the regular polygon. Therefore, different shapes can be set based on actual needs to meet different performance of the millimeter-wave antenna and enable the terminal device to have better adaptability. It should be noted that the shapes of the groove, the coupling patch 3, and the radiating patch 4 may be the same or different. This is not limited in this embodiment.

Optionally, as shown in FIG. 3, a shape of each of the groove, the coupling patch 3, and the radiating patch 4 is a square; gaps between side edges of the coupling patch 3 and side walls of the groove are all equal; and gaps between side edges of the radiating patch 4 and the side walls of the groove are all equal.

In this embodiment, the shape of each of the groove, the coupling patch 3, and the radiating patch 4 is the square; the gaps between the side edges of the coupling patch 3 and the side walls of the groove are all equal; and the gaps between the side edges of the radiating patch 4 and the side walls of the groove are all equal. Therefore, a better symmetry can be ensured, and an appearance of the terminal device is relatively artistic.

In addition, a side length or a circumference of the coupling patch 3 or the radiating patch 4 is less than a side length or a circumference of the groove, so that the terminal device may have a better appearance. It should be noted that if side lengths or circumferences of grooves at different depths are changed, in this case, the side length or the circumference of the coupling patch 3 or the radiating patch 4 is less than the smallest side length or circumference of the groove.

Optionally, the at least two grooves are formed in the same side face of the metal frame 1.

In this embodiment, the foregoing at least two grooves are formed in the same side face of the metal frame 1. Therefore, the coupling patches 3 and the radiating patches 4 in the grooves on the same side face may form a millimeter-wave array antenna to facilitate receiving or radiating a millimeter-wave signal.

Optionally, the at least two grooves are distributed in the length direction of the metal frame 1. A plurality of grooves are distributed in rows, which may be in one row, or in two or more rows. This is not limited herein, and may be determined based on a size of the frame of the terminal device.

In this embodiment, the foregoing at least two grooves are distributed in the length direction of the metal frame 1. First, a plurality of grooves can be formed in the metal frame 1. Second, each groove, coupling patch 3, radiating patch 4, and feed source form a millimeter-wave array antenna to radiate or receive a millimeter-wave signal. The millimeter-wave antenna may cover a plurality of millimeter-wave bands and has a multiple-input multiple-output (that is, MIMO) function.

Optionally, an interval between two adjacent millimeter-wave antennas is determined by isolation between the two adjacent millimeter-wave antennas and performance of a beam scanning coverage angle of an array antenna.

In this embodiment, the interval between the two adjacent millimeter-wave antennas is determined by the isolation between the two adjacent millimeter-wave antennas and the performance of the beam scanning coverage angle of the array antenna, so as to better match with millimeter-wave signals to work.

Optionally, diameters of grooves in a depth direction may be the same or different. A diameter, close to the outer wall of the metal frame, of the groove is less than a diameter, away from the outer wall of the metal frame, of the groove.

In this embodiment, to better understand the foregoing setting method, refer to FIG. 4. In FIG. 4, a diameter of the groove in a Y-axis direction is changed. That is, the edge of the square on the outer surface of the metal frame 1 is shorter, and optionally, may be 4.6 mm, and the edge of the square in the groove is longer, and optionally, may be 5.0 mm. In this way, a metal appearance of the terminal device may be optimized. A length of an edge of a square structure of each of the coupling patch 3 and the radiating patch 4 is less than a length of an edge of the groove.

Optionally, the first through hole and the second through hole are both circular holes, or may be in other shapes. This is not limited herein.

In this embodiment, the first through hole and the second through hole are both the circular holes, to facilitate puncturing.

The embodiments of the present disclosure provide a terminal device, including at least two feed sources, a metal frame 1, coupling patches, and radiating patches, where at least two grooves are formed in the outer side surface of the metal frame 1, two first through holes are formed in each groove, a coupling patch and a radiating patch are arranged in each groove, and the metal frame 1 is grounded; the coupling patch in each groove is arranged between the radiating patch and the bottom of the groove, and two second through holes are formed in the coupling patch; two antenna feed points are arranged on each radiating patch, each feed source is connected to one antenna feed point through one first through hole and one second through hole, and the antenna feed points, the first through holes, and the second through holes in each groove are in one-to-one correspondence; and the metal frame 1, the coupling patch, and the radiating patch are not in contact with one another, and a non-conductive material is filled between the metal frame, the coupling patch, and the radiating patch, and an area of the radiating patch is less than an area of the coupling patch. In this way, the at least two grooves, the coupling patches, the radiating patches, and the feed sources constitute a millimeter-wave array antenna of the terminal device, and in addition, the metal frame 1 is also a radiator of a non-millimeter-wave communications antenna. Therefore, the accommodating space for the millimeter-wave antenna is saved, the size of the terminal device can be reduced, and a design of a metal appearance can be better supported, and can be compatible with a solution that an appearance metal is used as another antenna, so that overall competitiveness of the terminal device is improved. In addition, the millimeter-wave antenna may cover a plurality of millimeter-wave bands and has a multiple-input multiple-output (that is, MIMO) function.

It should be noted that in this specification, the terms "comprise", "include" and any other variants thereof are intended to cover non-exclusive inclusion, so that a process, a method, an article, or an apparatus that includes a series of elements not only includes these very elements, but may also include other elements not expressly listed, or also include elements inherent to this process, method, article, or apparatus Without being subject to further limitations, an element defined by a phrase "including a" does not exclude presence of other identical elements in the process, method, article, or apparatus that includes the very element.

The embodiments of the present disclosure are described above with reference to the accompanying drawings, but the present disclosure is not limited to the foregoing specific implementations. The foregoing specific implementations are merely schematic instead of restrictive. Under enlightenment of the present disclosure, a person of ordinary skills in the art may make many forms without departing from the protection scope of aims of the present disclosure and claims, all of which fall within the protection of the present disclosure.

What is claimed is:

1. A terminal device, comprising feed sources, a metal frame, coupling patches, and radiating patches, wherein at least two grooves are formed in the outer side surface of the metal frame, two first through holes are formed in each groove, a coupling patch of the coupling patches and a radiating patch of the radiating patches are arranged in each groove, and the metal frame is grounded; the coupling patch in each groove is arranged between the radiating patch and the bottom of the groove, and two second through holes are formed in each coupling patch;

two antenna feed points are arranged on each radiating patch, each feed source is connected to the corresponding antenna feed point of each two antenna feed points arranged on each radiating patch through the respective first through hole and the respective second through hole, and the antenna feed points, the first through holes, and the second through holes in each groove are in one-to-one correspondence; and the metal frame, the coupling patch, and the radiating patch are not in contact with one another, and a non-conductive material is filled between the metal frame, the coupling patch, and the radiating patch, and an area of the radiating patch is less than an area of the coupling patch; the feed source is a millimeter-wave feed source.

2. The terminal device according to claim 1, wherein the two through holes in each groove are at the bottom of the groove.

3. The terminal device according to claim 2, wherein the two second through holes in each coupling patch directly face the two first through holes at the bottom of each groove.

4. The terminal device according to claim 3, wherein a first straight line determined by one of the two first through holes at the bottom of each groove and a center of the bottom of the groove is parallel to a length direction of the metal frame, a second straight line determined by the other first through hole and the center of the bottom of the groove is parallel to a width direction of the metal frame, and the first straight line is perpendicular to the second straight line;

a third straight line determined by one of the two second through holes in each coupling patch and a center of the coupling patch is parallel to the length direction of the metal frame, a fourth straight line determined by the other second through hole and the center of the coupling patch is parallel to the width direction of the metal frame, and the third straight line is perpendicular to the fourth straight line; and a fifth straight line determined by one of the two antenna feed points on each radiating patch and a center of the radiating patch is parallel to the length direction of the metal frame, a sixth straight line determined by the other antenna feed point and the center of the radiating patch is parallel to the width direction of the metal frame, and the fifth straight line is perpendicular to the sixth straight line.

5. The terminal device according to claim 1, wherein a surface, away from the coupling patch, of the radiating patch is aligned with a plane at which an outer side wall of the metal frame is located.

6. The terminal device according to claim 1, wherein a shape of the groove, the coupling patch, or the radiating patch is a circle or a regular polygon.

7. The terminal device according to claim 1, wherein a shape of each of the groove, the coupling patch, and the radiating patch is a square; gaps between side edges of the coupling patch and side walls of the groove are all equal; and gaps between side edges of the radiating patch and the side walls of the groove are all equal.

8. The terminal device according to claim 7, wherein the at least two grooves are formed in the same side face of the metal frame.

9. The terminal device according to claim 1, wherein the at least two grooves are distributed in the length direction of the metal frame.

10. The terminal device according to claim 1, wherein a diameter, close to the outer wall of the metal frame, of the groove is less than a diameter, away from the outer wall of the metal frame, of the groove.

* * * * *